US007832880B2

(12) United States Patent
Craig

(10) Patent No.: US 7,832,880 B2
(45) Date of Patent: Nov. 16, 2010

(54) MIRROR MOUNT HAVING PLURAL FLEXURE ELEMENTS

(75) Inventor: Ian Muir Craig, Broxburn (GB)

(73) Assignee: Selex Galileo Ltd, Essex (GB)

( * ) Notice: Subject to any disclaimer, the term of this patent is extended or adjusted under 35 U.S.C. 154(b) by 0 days.

(21) Appl. No.: 11/882,182

(22) Filed: Jul. 31, 2007

(65) Prior Publication Data

US 2008/0035824 A1 Feb. 14, 2008

(30) Foreign Application Priority Data

Aug. 8, 2006 (EP) ..... 06254142
Aug. 8, 2006 (GB) ..... 0615727.5

(51) Int. Cl.
*G02B 5/22* (2006.01)
*G02B 26/08* (2006.01)

(52) U.S. Cl. ..... 359/872; 359/224.1

(58) Field of Classification Search ..... 359/872, 359/224.1

See application file for complete search history.

(56) References Cited

U.S. PATENT DOCUMENTS 2,793,028 A 5/1957 Wheeler
4,060,315 A 11/1977 Heinz
4,261,211 A 4/1981 Haberland
4,637,596 A 1/1987 Lewis
4,802,720 A * 2/1989 Paulsen ..... 359/226.2
4,802,784 A 2/1989 Brooks
5,620,169 A 4/1997 Payne
5,844,732 A * 12/1998 Huiban et al. ..... 359/872
6,283,666 B1 9/2001 Genequand

FOREIGN PATENT DOCUMENTS

DE 39 34 381 A1 4/1991
EP 0 449 001 A1 10/1991

OTHER PUBLICATIONS

Great Britain Search Report for related Application No. GB 0615727.5.
European Search Report for related Application No. EP 06 25 4142.
Office Action dated Jul. 26, 2010 in a corresponding European Patent Application, 4 pps.

* cited by examiner

*Primary Examiner*—Stephone B Allen
*Assistant Examiner*—Jade R Chwasz
(74) *Attorney, Agent, or Firm*—Buchanan Ingersoll & Rooney PC

(57) ABSTRACT

A mirror mount includes a two-axis mirror flexure mount with increased stiffness in all but the desired degrees of freedom. The mount is an integrally formed support for a mirror and includes a rigid portion, a plurality of base portions suitable for mounting the mirror thereto, and a plurality of substantially linear flexure elements disposed between the mount portion and the base portion to connect the mount portion and the base portion together. The flexure elements each define an axis of rotation and are operable to allow the mount portion to rotate relative to the base portion along either axis of rotation.

15 Claims, 2 Drawing Sheets

MIRROR MOUNT HAVING PLURAL FLEXURE ELEMENTS

The present invention relates to a mirror mount. In particular, the present invention relates to a two-axis mirror flexure mount with increased stiffness in all but the desired degrees of freedom.

Rigid body motion can be described by 3 orthogonal displacements (z,y,z) and 3 orthogonal possible rotations (Rx, Ry, Rz) relative to a Cartesian coordination system. Each of these motions can be called a degree of freedom.

It is known to provide supports for mirrors that allow, for example, rotation in two orthogonal axes (e.g. the Rx and Ry degrees of freedom) but that restrict rotation in the remaining orthogonal axis (i.e. the Rz degree of freedom) and movement in all three axes (i.e. the x-, y- and z-degrees of freedom). This stabilises the mirror mounted on the support, reducing jitter. It follows that an ideal support would thus have infinite stiffness in the x-, y-, z- and Rz degrees of freedom. It is important to have high stiffnesses in the 4 restrained directions in order to achieve precision and very quick responses of the mirror to control demands.

Various attempts have been made to achieve this design goal. One such common example is the continuous rotation bearing. This, however, trades off friction for bearing radial stiffness and, as a result, is far from ideal.

Another known support is the flexure bearing. Flexure bearings have the advantage over most other bearings that they are simple and thus inexpensive. They are also often compact, lightweight and are free from the "stick-slip" effect as experienced by the continuous rotation bearing. However, known designs of flexure bearing, such as the Wheeler (U.S. Pat. No. 2,793,028) or Lewis (U.S. Pat. No. 4,637,596) flexural pivots are complex as they are fabricated from a number of piece parts and fall considerably short of the design goal to have infinite stiffness in the 3 linear directions. Additionally, they are not easily scaled down to miniature components as the piece parts become too small.

These known designs have fabrication material and method constraints and thus prevent the selection of an "ideal" material and monolithic fabrication process.

The present invention seeks to mitigate the problems associated with the known designs described above through its monolithic manufacturing process that has high flexibility to choice of ideal material. An example of such an ideal material is forging grade Titanium alloy.

The present invention provides an integrally formed support for a mirror comprising; a rigid portion; a plurality of base portions suitable for mounting the mirror thereto; and a plurality of substantially linear flexure elements provided substantially perpendicular to one another and disposed between the mount portion and the base portion to connect the mount portion and the base portion together; wherein the flexure elements each define an axis of rotation and are operable to allow the mount portion to rotate relative to the base portion along either said axis of rotation.

The advantages of the present invention recited above are: the mount requires a smaller volume to provide the same stiffness; the mount's ability to withstand stresses produced by relatively large angular motions (±100 mR typical) in the free axes of rotation; a reduced cost of manufacture; an improved geometrical accuracy; and potentially better reliability.

Specific embodiments of the invention will now be described, by way of example only and with reference to the accompanying drawings that have like reference numerals, wherein:—

A first embodiment of the present invention will now be described with reference to FIGS. 1 to 2E.

Figure 1:
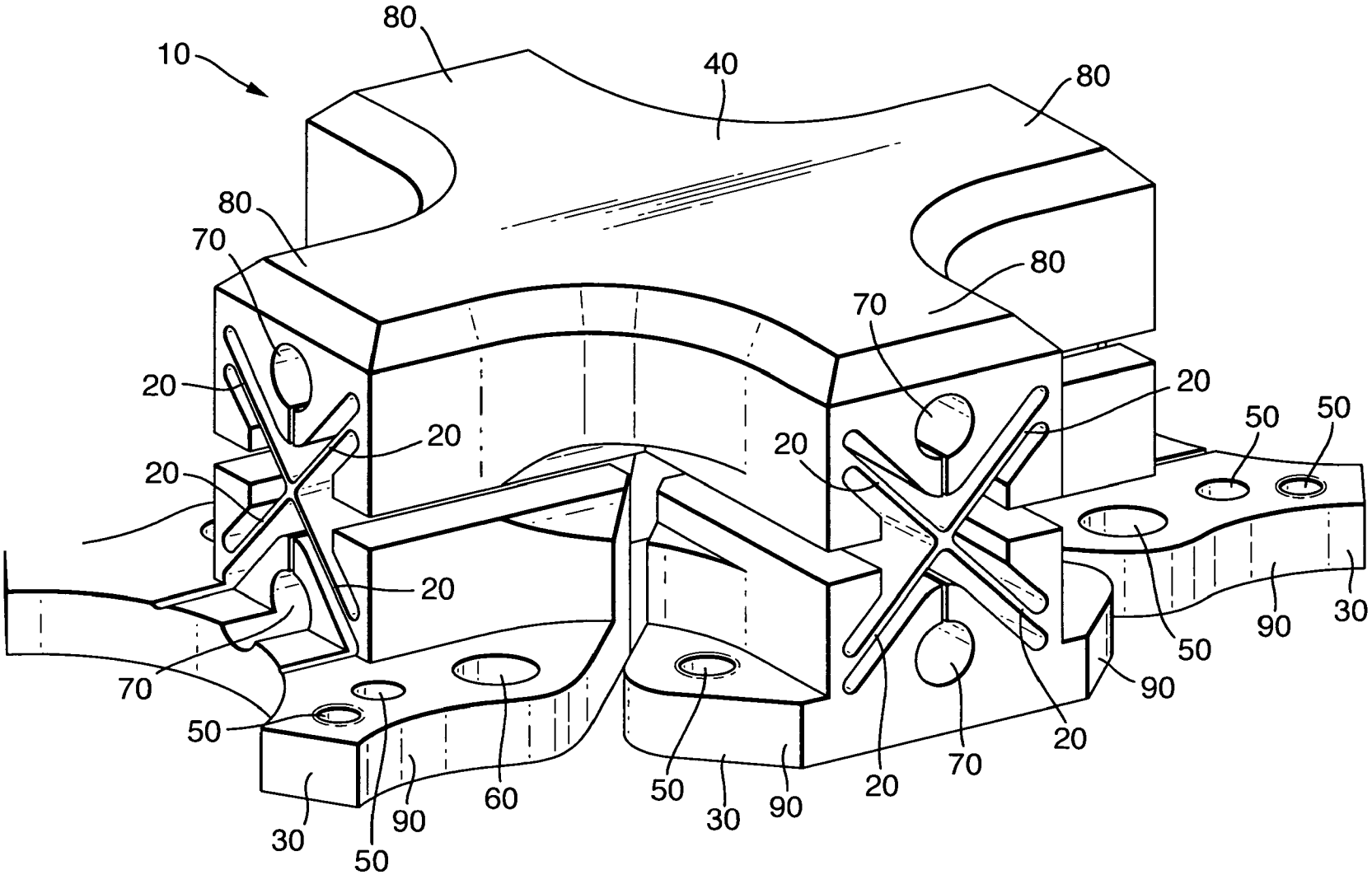
FIG. 1 is a perspective view of a support according to an embodiment of the invention.
Figure 2A:
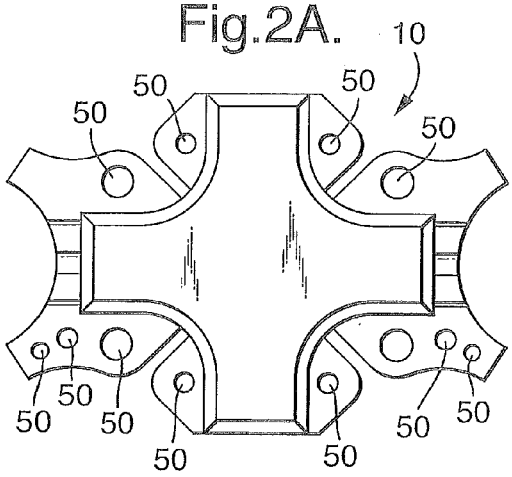
FIG. 2A is a plan view of the support shown in FIG. 1.
Figure 2B:
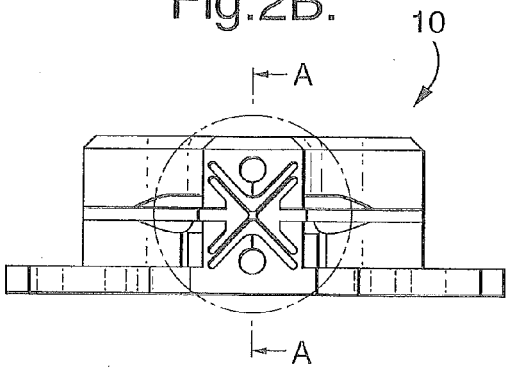
FIG. 2B is a side view of the support shown in FIG. 1.
Figure 2D:
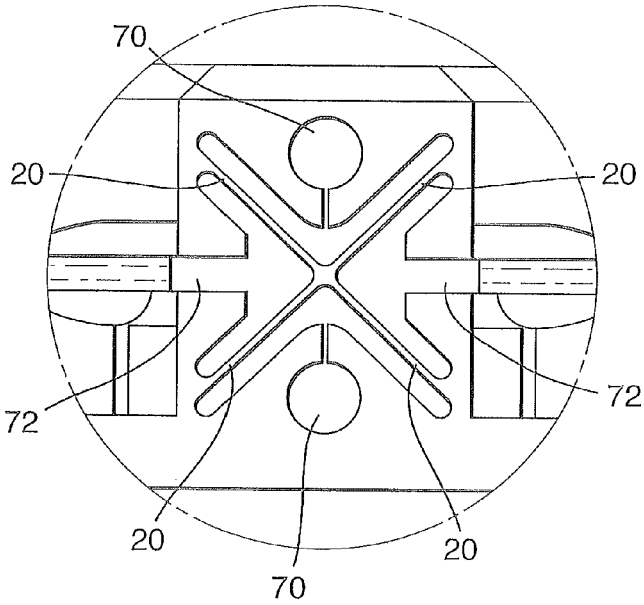
FIG. 2D is an enlarged view of detail A of FIG. 2B.
Figure 2C:
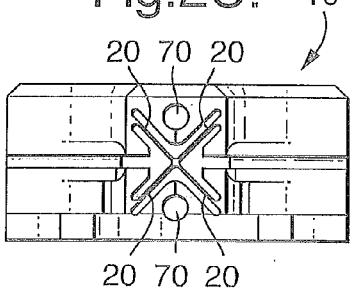
FIG. 2C is an alternative side view of the support shown in FIG. 1.
Figure 2E:
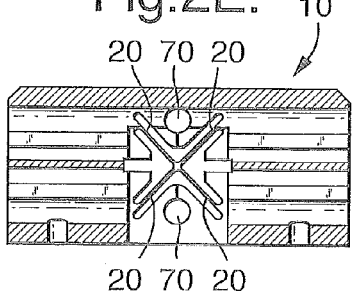
FIG. 2E is a section view of the support of FIG. 1 through line A-A shown in FIG. 2B.

Referring to FIGS. 1 to 2E, a support 10 according to the first embodiment of the present invention is shown. The support 10 is manufactured from a single homogeneous high fatigue strength material, using precision wire erosion techniques.

The support 10 comprises a non-flexible rigid portion 40, arranged in a substantially "cross-shaped" configuration having four arm portions 80. The support 10 further comprises four integrally formed base portions 30, each formed integrally with each arm portion 80 of the cross-shaped non-flexible rigid portion 40. Each integrally formed base portion 30 comprises an integrally formed flange portion 90, each integrally formed flange portion 90 having located therethrough at least one bolt hole 50, 60.

The integrally formed base portions 30 are connected to the non-flexible rigid portion 40 with integrally formed flexure elements 20. The integrally formed base portions 30 are able to move relative to the non-flexible rigid portion 40 due to these flexure elements 20. This arrangement allows each integrally formed base portion 30 to rotate relative to the respective axis of each arm portion 80 of the non-flexible rigid portion 40.

To manufacture the above described support 10, among other techniques, a wire erosion process is utilised to integrally form the flexure elements 20 and thus integrally form the support member 10. This part of the manufacturing process will now be described.

Initially, wire erosion start holes 70 are created through the opposing arm portions 80 of the non-flexible rigid portion 40 and the opposing arm portions 80 of the integrally formed base portions 30. Through this, a wire is placed and then used to erode a "V-shaped" portion of the support 10 to form the top and bottom outer portions of the flexure elements 20.

Further, wire erosion is used to remove the side segments 72 of the support 10 between the non-flexible rigid portion 40 and the integrally formed base portions 30 and to erode a "V-shaped" portion of the support 10, forming the left and right outer portions of the flexure elements 20, leaving only the flexure elements 20 connecting the non-flexible rigid portion 40 and the integrally formed base portions 30.

The resulting flexure elements 20 form a "x-shaped" cross-section along the axis of each arm 80 of the support 10, formed integrally with the non-flexible rigid portion 40 and the integrally formed base portions 30.

In use, the support 10 is fastened to a mirror using some of the bolt holes 50 formed in the integrally formed flange portions 90 of the integrally formed base portion 30. The mirror can then be moved using actuators connected to the mirror through the remaining bolt holes 60 formed in the integrally formed flange portions 90 of the integrally formed base portion 30.

In the above described embodiment of the present invention, the flexure elements 20 are configured in a "x-shaped" cross section, where each flexural element 20 is of constant thickness. In an alternative embodiment, the flexural elements can be tapered such that their thickness is greatest at the centre of the "x-shaped" cross-section and least at the extremities of the "x-shaped" cross-section. The advantage of this alternative configuration is that the configuration of flexural elements 20 has more structural rigidity.

It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. A mount for a mirror on a support, said mount comprising;

a rigid portion;

a plurality of base portions; and a plurality of substantially linear flexure elements, wherein a first set of said flexure elements defines a first axis of rotation and is disposed between at least one base portion and said rigid portion and a second set of said flexure elements defines a second axis of rotation, and is disposed between at least another one of said base portions and said rigid portion, wherein said first axis of rotation is substantially perpendicular to said second axis of rotation, wherein the plural linear flexure elements in each of the first set and second set are joined at a common point on the first and second axes of rotation, respectively.

2. The mount for a mirror according to claim 1, wherein said flexure elements are tapered in thickness.

3. The mount for a mirror according to claim 1, wherein said plurality of base portions comprises two base portions.

4. The mount for a mirror according to claim 1, wherein said plurality of base portions comprises two pairs of base portions.

5. The mount of claim 1, wherein the first set of said flexure elements is integrally formed in said at least one base portion.

6. The mount of claim 1, wherein the second set of said flexure elements is integrally formed in said at least another one of said base portions.

7. The mount of claim 1, wherein the said rigid portion comprises plural arms, each arm being integrally formed with one of said plural base portions, wherein said flexure elements form an x-shaped cross-section along the axis of each arm.

8. The mount of claim 1, wherein said rigid portion, said plurality of base portions, and said plurality of substantially linear flexure elements are comprised in a single homogenous material.

9. A mount for a mirror on a support, said mount comprising;

a rigid portion;

a plurality of base portions; and a plurality of substantially linear flexure elements, wherein a first set of said flexure elements defines a first axis of rotation and is disposed between at least one base portion and said rigid portion and a second set of said flexure elements defines a second axis of rotation; and is disposed between at least another one of said base portions and said rigid portion, wherein said first axis of rotation substantially perpendicular to said second axis of rotation, wherein the plural linear flexure elements in each of the first set and second set are joined at a common point on the first and second axes of rotation respectively, said at least one base portion is attached to said mirror, and said at least another base portion is attached to said support, wherein the first and second sets of flexure elements permit rotation of said mirror relative to said support along said first and second axes of rotation, respectively, and each of said flexure elements comprises at least one flange having at least two edges, one of said at least two edges integral with said rigid portion and the other of said at least two edges integral with at least one of said base portion.

10. The mount for a mirror according to claim 9, wherein each of said flexure elements includes four flanges in an x-shaped cross section, two of said flanges integral with said rigid portion and two of said flanges integral with said at least one of said base portions.

11. The mount of claim 9, wherein the rigid portion and the plural base portions are integrally formed.

12. A mount for a mirror on a support, said mount comprising;

a rigid portion;

four base portions; and plural linear flexure elements, wherein a first set of said flexure elements defines a first axis of rotation and is disposed between one pair of base portions and said rigid portion and a second set of said flexure elements defines a second axis of rotation and is disposed between another pair of said base portions and said rigid portion, wherein said first axis of rotation is substantially perpendicular to said second axis of rotation, wherein the plural linear flexure elements in each of the first set and second set are joined at a common point on the first and second axes of rotation respectively, the first pair of base portions attached to said mirror, and said second pair of base portions being attached to said support, wherein the first and second set of flexure elements together permit rotation of said mirror relative to said support along either said first and second axes of rotation and each of said sets of flexure elements comprises at least one flange having at least two edges, one of said at least two edges integral with said rigid portion and the other of said at least two edges integral with at least one of said base portions.

13. The mount for a mirror according to claim 12, wherein each of said sets of flexure elements includes four flanges in an x-shaped cross section, two of said flanges integral with said rigid portion and two of said flanges integral with at least one of said base portions.

14. The mount for a mirror according to claim 12, wherein said first set of flexure elements includes four flanges in an x-shaped cross section, two of said flanges integral with said rigid portion and two of said flanges integral with said base portions attached to said mirror and said second set of flexure elements includes four flanges in an x-shaped cross section, two of said flanges integral with said rigid portion and two of said flanges integral with said base portions attached to said support.

15. The mount of claim 12, wherein the rigid portion and the plural base portions are integrally formed.

* * * * *